US012352481B2

(12) United States Patent
Hisayama et al.

(10) Patent No.: US 12,352,481 B2
(45) Date of Patent: Jul. 8, 2025

(54) REFRIGERANT APPARATUS

(71) Applicant: DAIKIN INDUSTRIES, LTD., Osaka (JP)

(72) Inventors: Kazushi Hisayama, Osaka (JP); Masanori Ukibune, Osaka (JP); Tetsuya Okamoto, Osaka (JP); Masao Ohno, Osaka (JP); Kebi Chen, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 132 days.

(21) Appl. No.: 17/956,605

(22) Filed: Sep. 29, 2022

(65) Prior Publication Data

US 2023/0014957 A1 Jan. 19, 2023

Related U.S. Application Data

(63) Continuation of application No. PCT/JP2021/013952, filed on Mar. 31, 2021.

(30) Foreign Application Priority Data

Mar. 31, 2020 (JP) ..... 2020-064512

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01)

(58) Field of Classification Search
CPC ..... F25B 49/02; F25B 13/00
See application file for complete search history.

(56) References Cited

U.S. PATENT DOCUMENTS 6,227,812 B1 5/2001 Kawaguchi et al.
9,372,021 B2 6/2016 Kato et al.
2010/0162742 A1 7/2010 Shimoda et al.
(Continued)

FOREIGN PATENT DOCUMENTS

CN 104501437 A * 4/2015
JP 10-253174 A 9/1998
(Continued)

OTHER PUBLICATIONS

Shen, Heat Pump System and Operation Method Thereof, 2014, Full Document (Year: 2014).*
(Continued)

*Primary Examiner* — Nael N Babaa
(74) *Attorney, Agent, or Firm* — Birch, Stewart, Kolasch & Birch, LLP

(57) ABSTRACT

A refrigeration apparatus includes a refrigerant circuit switchable between a first operation of performing a refrigeration cycle in which a first compressor is stopped and a second compressor is driven and a second operation of performing a refrigeration cycle in which the first and second compressors and are driven. The refrigeration apparatus further includes a reduction mechanism configured to reduce a refrigerant flowing into the first compressor while a first condition is satisfied during the first operation. The first condition indicates that an internal pressure of the first compressor is lower than an evaporation pressure of an evaporator.

19 Claims, 13 Drawing Sheets

(56) References Cited

U.S. PATENT DOCUMENTS

| | | | | |
|---|---|---|---|---|
| 2011/0283723 | A1* | 11/2011 | Yakumaru | F25B 49/025 62/126 |
| 2013/0199224 | A1 | 8/2013 | Kato et al. | |
| 2016/0238297 | A1* | 8/2016 | Nuno | F25B 41/20 |

FOREIGN PATENT DOCUMENTS

| | | | |
|---|---|---|---|
| JP | 2007-10282 | A | 1/2007 |
| JP | 2008-64421 | A | 3/2008 |

OTHER PUBLICATIONS

Extended European Search Report for corresponding European Application No. 21780702.3, dated Jul. 6, 2023.
European Communication pursuant to Article 94(3) EPC for European Application No. 21780702.3, dated Mar. 21, 2024.
International Preliminary Report on Patentability and English translation of the Written Opinion of the International Searching Authority for International Application No. PCT/JP2021/013952, dated Oct. 13, 2022.
International Search Report for PCT/JP2021/013952 (PCT/ISA/210) mailed on May 18, 2021.
Written Opinion of the International Searching Authority for PCT/JP2021/013952 (PCT/ISA/210) mailed on May 18, 2021.

* cited by examiner

REFRIGERANT APPARATUS

CROSS REFERENCE TO RELATED APPLICATIONS

This application is a Continuation of PCT International Application No. PCT/JP2021/013952, filed on Mar. 31, 2021, which claims priority under 35 U.S.C. 119(a) to Patent Application No. 2020-064512, filed in Japan on Mar. 31, 2020, all of which are hereby expressly incorporated by reference into the present application.

TECHNICAL FIELD

The present disclosure relates to a refrigeration apparatus.

BACKGROUND ART

Patent Document 1 discloses a refrigeration apparatus including a refrigerant circuit. The refrigerant circuit includes a first compressor and a second compressor connected to the discharge side of the first compressor. This refrigeration apparatus is switchable between a first operation in which the first compressor is stopped and the second compressor is driven and a second operation in which the first and second compressors are driven.

CITATION LIST

Patent Document

Patent Document 1: Japanese Unexamined Patent Publication No. 2008-64421

SUMMARY

A first aspect of the present disclosure is directed to a refrigeration apparatus including: a refrigerant circuit (20) including a first compressor (21), a second compressor (22) connected to a discharge side of the first compressor (21), and an evaporator (24, 27). The refrigerant circuit (20) is switchable between a first operation of performing a refrigeration cycle in which the first compressor (21) is stopped and the second compressor (22) is driven and a second operation of performing a refrigeration cycle in which the first and second compressors (21) and (22) are driven. The refrigerant circuit (20) includes a bypass line (PB) that connects a suction side and the discharge side of the first compressor (21) together. The refrigeration apparatus further includes a reduction mechanism (50) configured to reduce a refrigerant flowing into the first compressor (21) while a first condition is satisfied during the first operation. The first condition indicates that an internal pressure of the first compressor (21) is lower than an evaporation pressure of the evaporator (24, 27).

DESCRIPTION OF EMBODIMENTS

Figure 1:
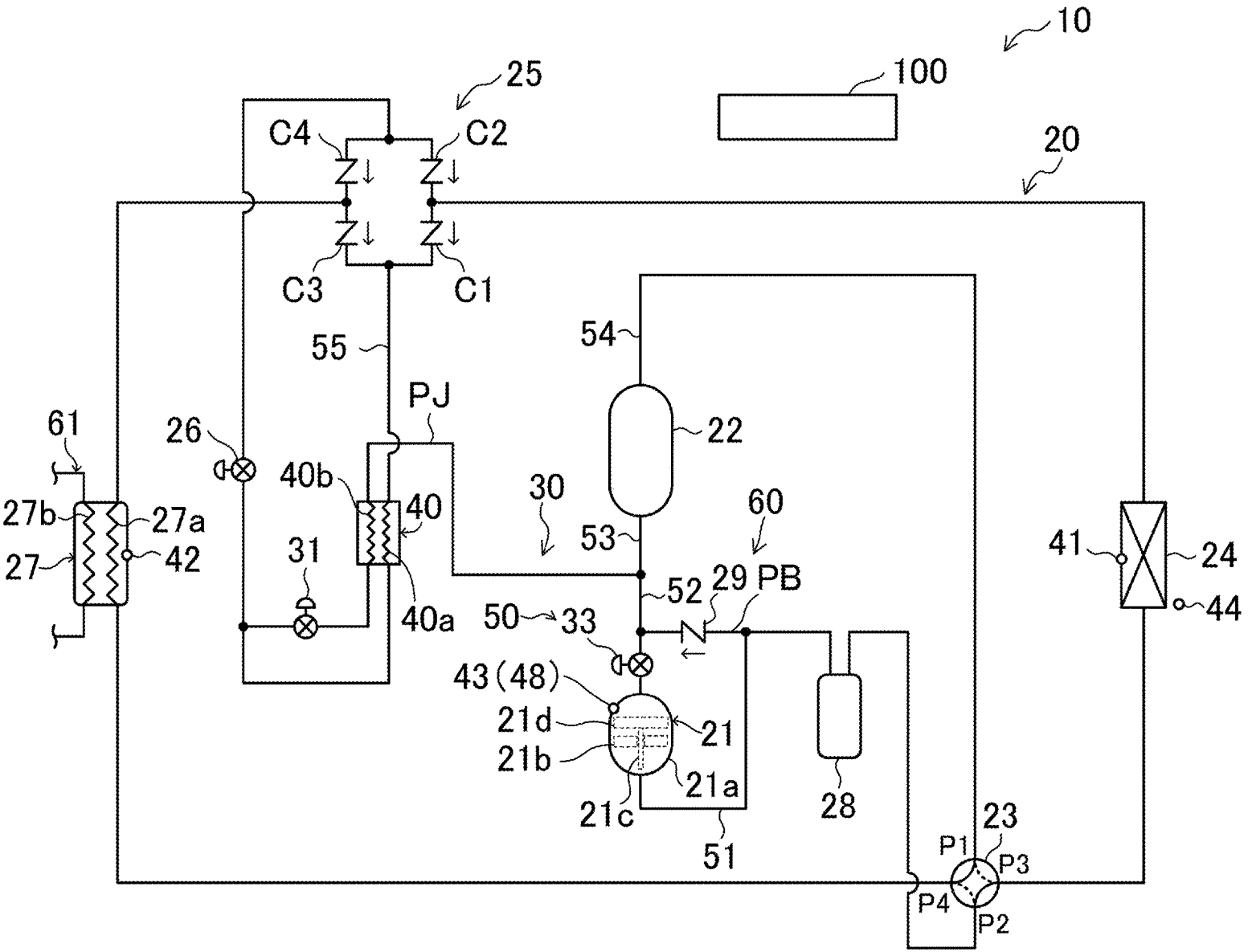
FIG. 1 is a piping diagram illustrating a configuration of a refrigeration apparatus according to a first embodiment.

Embodiments of the present disclosure will be described below with reference to the drawings. The following embodiments are merely exemplary ones in nature, and are not intended to limit the scope, applications, or use of the invention. Arrows in the drawings indicate the flow of a refrigerant through a refrigerant circuit.

First Embodiment

As illustrated in FIG. 1, a refrigeration apparatus (10) of this first embodiment heats a target fluid. The target fluid is water. The refrigeration apparatus (10) supplies heated water to devices used, such as a boiler, a coil for heating, and a coil for floor heating. The refrigeration apparatus (10) cools the target fluid. The target fluid is water. The refrigeration apparatus (10) supplies cooled water to devices used, such as a coil for cooling. The refrigeration apparatus (10) includes a refrigerant circuit (20), a reduction mechanism (50), and a control unit (100).

[Refrigerant Circuit]

The refrigerant circuit (20) includes a first compressor (21), a second compressor (22), a four-way switching valve (23), a heat-source-side heat exchanger (24), a check-valve bridge (25), an expansion valve (26), a utilization-side heat exchanger (27), an accumulator (28), and a bypass check valve (29). The refrigerant circuit (20) is filled with a refrigerant, which circulates in the refrigerant circuit (20) to perform a refrigeration cycle. The refrigerant is, for example, a refrigerant R410A, R32, or R407C.

The refrigerant circuit (20) can perform a first operation and a second operation. In the first operation, the second compressor (22) is driven, and the first compressor (21) is stopped. In the second operation, both of the first and second compressors (21) and (22) are driven. The first and second operations will be described later in detail.

<First Compressor>

The first compressor (21) compresses a refrigerant sucked thereinto and discharges the compressed refrigerant. A first suction pipe (51) and a first discharge pipe (52) are connected to the first compressor (21).

The first compressor (21) is, for example, a scroll compressor. The first compressor (21) includes a casing (21*a*), a motor (21*b*), a drive shaft (21*c*), a compression mechanism (21*d*), and a heater (37).

The casing (21*a*) has a cylindrical shape. The casing (21*a*) is a pressure container. The inside of the casing (21*a*) is the inside of the first compressor (21).

The motor (21*b*) is disposed in the casing (21*a*). The motor (21*b*) includes a stator and a rotor (neither of which is shown). The stator is fixed to the inner peripheral surface of the casing (21*a*). The rotor is provided inside the stator. A coil is wound around the rotor.

The drive shaft (21*c*) is disposed in the casing (21*a*). The drive shaft (21*c*) is fixed inside the rotor. Power supplied to the motor (21*b*) allows the rotor to rotate. As a result, the drive shaft (21*c*) rotates.

The compression mechanism (21*d*) is disposed in the casing (21*a*). The compression mechanism (21*d*) includes a fixed scroll and an orbiting scroll (neither of which is shown). The compression mechanism (21*d*) is connected to the drive shaft (21*c*). The compression mechanism (21*d*) is driven by rotation of the drive shaft. The driven compression mechanism (21*d*) compresses a low-pressure gas refrigerant sucked into the first compressor (21), and discharges the resultant high-pressure gas refrigerant.

The number of revolutions of the first compressor (21) is variable. For example, changing the output frequency of an inverter (not shown) connected to the first compressor (21) triggers a change in the number of revolutions of the motor (21*b*). As a result, the number of revolutions (operation frequency) of the first compressor (21) changes.

<Second Compressor>

The second compressor (22) is provided on the discharge side of the first compressor (21). The second compressor (22) compresses a refrigerant sucked thereinto and discharges the compressed refrigerant. The second compressor (22) has a larger capacity than the first compressor (21). A second suction pipe (53) and a second discharge pipe (54) are connected to the second compressor (22). The second suction pipe (53) corresponds to a suction line. The inlet end of the second suction pipe (53) is connected to the outlet end of the first discharge pipe (52). The first and second compressors (21) and (22) are connected together in series.

The second compressor (22) is, for example, a scroll compressor. The second compressor (22) is the same as the first compressor (21), and a casing, a drive shaft, and a compression mechanism of the second compressor (22) are not shown.

The number of revolutions of the second compressor (22) is variable. For example, changing the output frequency of an inverter (not shown) connected to the second compressor (22) triggers a change in the number of revolutions of a motor (21*b*). As a result, the number of revolutions (operation frequency) of the second compressor (22) changes.

<Four-Way Switching Valve>

The four-way switching valve (23) is a motor-operated switching valve. The four-way switching valve (23) switches between a first state (the state indicated by the solid curves in FIG. 1) and a second state (the state indicated by the dotted curves in FIG. 1). In the first state, a first port (P1) and a fourth port (P4) communicate with each other, and a second port (P2) and a third port (P3) communicate with each other. In the second state, the first port (P1) and the third port (P3) communicate with each other, and the second port (P2) and the fourth port (P4) communicate with each other.

The first port (P1) is connected to the outlet end of the second discharge pipe (54). The second port (P2) is connected to the inlet end of the first suction pipe (51). The third port (P3) communicates with the gas-side end of the heat-source-side heat exchanger (24). The fourth port (P4) communicates with the gas-side end of the utilization-side heat exchanger (27).

<Heat-Source-Side Heat Exchanger>

The heat-source-side heat exchanger (24) exchanges heat between the refrigerant and outdoor air (an example of a heat-source-side fluid). The heat-source-side heat exchanger (24) is an outdoor heat exchanger.

<Check-Valve Bridge>

The check-valve bridge (25) includes four lines and four check valves (C) connected to the respective lines. The four check valves (C) include a first check valve (C1), a second check valve (C2), a third check valve (C3), and a fourth check valve (C4).

The check-valve bridge (25) is connected to a main liquid pipe (55). Specifically, one end of the main liquid pipe (55) is connected to the inlet side of the second check valve (C2) and the inlet side of the fourth check valve (C4). The other end of the main liquid pipe (55) is connected to the outlet side of the first check valve (C1) and the outlet side of the third check valve (C3).

The check-valve bridge (25) communicates with the liquid-side end of the heat-source-side heat exchanger (24) and the liquid-side end of the utilization-side heat exchanger (27). Specifically, the outlet side of the second check valve (C2) and the inlet side of the first check valve (C1) communicate with the liquid-side end of the heat-source-side heat exchanger (24). The outlet side of the fourth check valve (C4) and the inlet side of the third check valve (C3) communicate with the liquid-side end of the utilization-side heat exchanger (27).

Each of the first to fourth check valves (C1 to C4) allows the refrigerant to flow in the direction indicated by the arrows in FIG. 1, and restricts the flow of the refrigerant in the opposite direction.

<Expansion Mechanism>

The expansion valve (26) expands the refrigerant to lower the pressure of the refrigerant. The expansion valve (26) corresponds to a decompression mechanism. In this example, the expansion valve (26) is configured as an expansion valve (e.g., an electronic expansion valve) having an adjustable opening degree. The expansion valve (26) is connected to the main liquid pipe (55).

<Utilization-Side Heat Exchanger>

The utilization-side heat exchanger (27) exchanges heat between the refrigerant and water. The utilization-side heat exchanger (27) has a first channel (27*a*) and a second channel (27*b*). The first channel (27*a*) is a channel through which the refrigerant flows. The second channel (27*b*) is a channel through which water flows. The second channel (27*b*) is connected to an intermediate portion of a utilization-side circuit (61) included in a device used. The utilization-side heat exchanger (27) exchanges heat between the refrigerant flowing through the first channel (27*a*) and water flowing through the second channel (27*b*).

<Accumulator>

The accumulator (28) is connected to an intermediate portion of the first suction pipe (51). The accumulator (28) is a gas-liquid separator. In the accumulator (28), a liquid refrigerant and a gas refrigerant are separated from each other. The accumulator (28) is configured to allow only the gas refrigerant to flow out of the accumulator (28).

<Bypass Circuit>

The bypass circuit (60) includes a bypass line (PB) and a bypass check valve (29). One end of the bypass line (PB) is connected to the outlet end of the first discharge pipe (52) and the inlet end of the second suction pipe (53). The other end of the bypass line (PB) is connected to a portion of the first suction pipe (51) between the accumulator (28) and the first compressor (21).

The bypass check valve (29) allows the refrigerant to flow in a direction from the first suction pipe (51) toward the inlet end of the second suction pipe (53), and restricts the flow of the refrigerant in the opposite direction.

[Injection Circuit]

The injection circuit (30) is a circuit through which a portion of the refrigerant flowing through the main liquid pipe (55) is supplied to the suction side of the second compressor (22) in the second operation. The injection circuit (30) includes an injection line (PJ) and an injection expansion valve (31).

One end of the injection line (PJ) is connected to a portion of the main liquid pipe (55) between the expansion valve (26) and the check-valve bridge (25). The other end of the injection line (PJ) is connected to the second suction pipe (53).

The injection expansion valve (31) is connected to a portion of the injection line (PJ) upstream of an intermediate heat exchanger (40). The injection expansion valve (31) decompresses the refrigerant flowing through the injection line (PJ).

[Intermediate Heat Exchanger]

The intermediate heat exchanger (40) has a third channel (40*a*) and a fourth channel (40*b*). The third channel (40*a*) is connected to an intermediate portion of the main liquid pipe (55). The fourth channel (40*b*) is connected to an intermediate portion of the injection line (PJ). The intermediate heat exchanger (40) exchanges heat between the refrigerant flowing through the main liquid pipe (55) and the refrigerant flowing through the fourth channel (40*b*).

[Sensor]

The refrigeration apparatus (10) includes various sensors, such as a temperature sensor for detecting the temperature of the refrigerant or any other material, and a pressure sensor for detecting the pressure of the refrigerant or any other material. Detection results of the various sensors (signals) are transmitted to the control unit (100). For example, the refrigeration apparatus (10) includes an internal temperature sensor (43), a first refrigerant temperature sensor (41), a second refrigerant temperature sensor (42), and an outdoor air temperature sensor (44).

The internal temperature sensor (43) corresponds to a first temperature sensor (48). The internal temperature sensor (43) is provided on an outer surface of the casing (21*a*) of the first compressor (21). The internal temperature sensor (43) detects the temperature of the outer surface of the casing (21*a*). The internal temperature Th1 of the first compressor (21) is determined based on the temperature of the outer surface of the casing (21*a*). The internal temperature Th1 of the first compressor (21) is based on a detection value detected by the internal temperature sensor (43).

The first refrigerant temperature sensor (41) is provided for the heat-source-side heat exchanger (24). The first refrigerant temperature sensor (41) detects the temperature of the refrigerant in the heat-source-side heat exchanger (24). While the heat-source-side heat exchanger (24) functions as an evaporator, the first refrigerant temperature sensor (41) detects the evaporation temperature Te1 of the heat-source-side heat exchanger (24).

The second refrigerant temperature sensor (42) is provided for the utilization-side heat exchanger (27). The second refrigerant temperature sensor (42) detects the temperature of the refrigerant circulating through the first channel (27*a*) of the utilization-side heat exchanger (27). While the utilization-side heat exchanger (27) functions as an evaporator, the second refrigerant temperature sensor (42) detects the evaporation temperature Te2 of the heat-source-side heat exchanger (27).

The outdoor air temperature sensor (44) detects the outdoor air temperature To that is the temperature of outdoor air around the refrigeration apparatus (10). The outdoor air temperature sensor (44) is disposed outdoors.

[Reduction Mechanism]

The refrigeration apparatus (10) includes a reduction mechanism (50). The reduction mechanism (50) includes an electromagnetic valve (33) and the control unit (100). The electromagnetic valve (33) corresponds to a valve of the present disclosure. The electromagnetic valve (33) is connected between the first compressor (21) and the outlet end of the bypass line (PB). The control unit (100) controls the electromagnetic valve (33). The electromagnetic valve (33) is switched between an open state and a closed state by the control unit (100).

[Control Unit]

Figure 2:
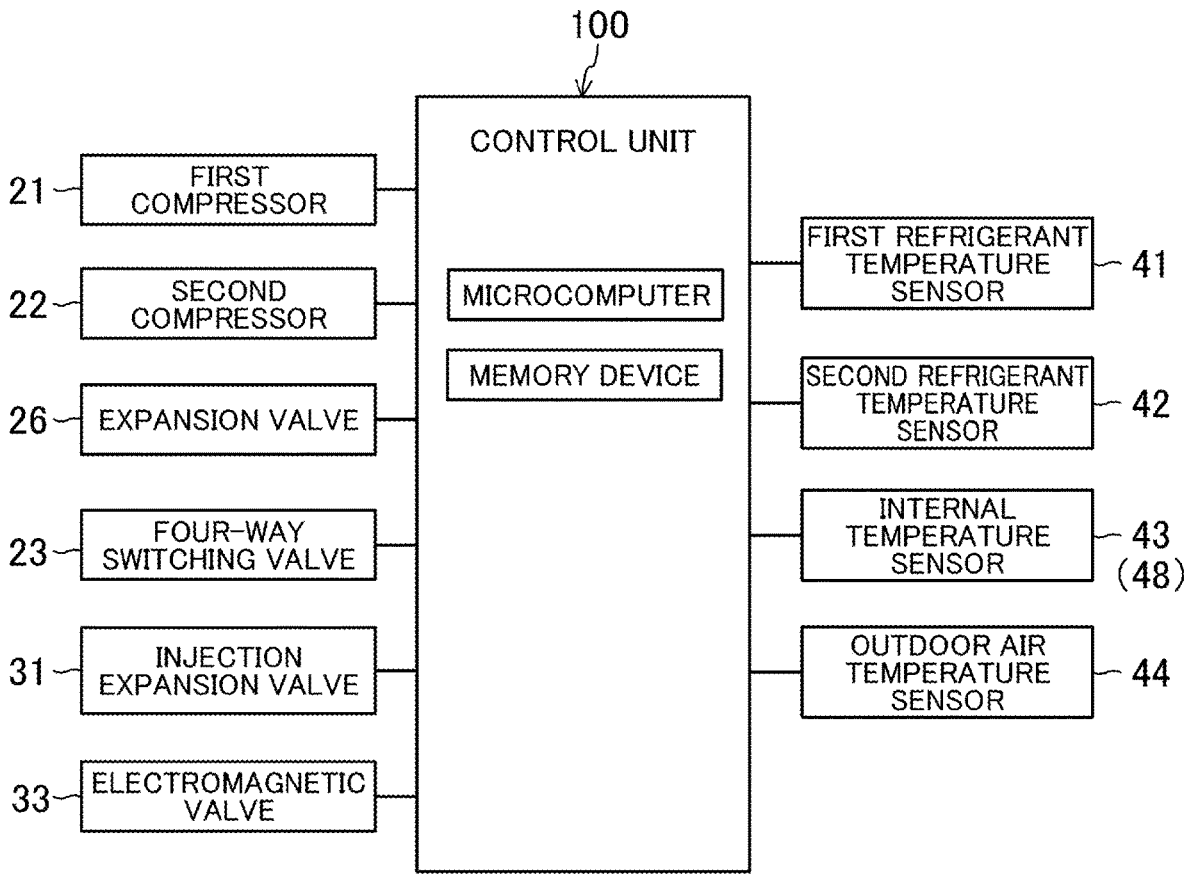
FIG. 2 is a block diagram illustrating the relationship among a control unit, various sensors, and components of a refrigerant circuit.

As illustrated in FIG. 2, the refrigeration apparatus (10) includes the control unit (100). The control unit (100) includes a microcomputer and a memory device that stores software for operating the microcomputer.

The control unit (100) controls the refrigerant circuit (20) based on the signals from the various sensors and external control signals. The control unit (100) includes a plurality of communication lines connected to the first compressor (21), the second compressor (22), the four-way switching valve (23), the expansion valve (26), the injection expansion valve (31), the electromagnetic valve (33), and the various sensors.

The control unit (100) includes an output section that outputs control signals to at least the first compressor (21), the second compressor (22), the four-way switching valve (23), the expansion valve (26), the injection expansion valve (31), and the electromagnetic valve (33). The control unit (100) includes an input section that receives detection values detected by the sensors.

[Operation of Refrigeration Apparatus]

The refrigeration apparatus (10) of the first embodiment performs a first operation and a second operation. The first operation includes a first heating operation and a first cooling operation. The second operation includes a second heating operation and a second cooling operation. In the second operation, the second compressor (22) functions as a high-stage compressor, and the first compressor (21) functions as a low-stage compressor. The refrigeration apparatus (10) performs a defrosting operation.

<First Heating Operation>

Figure 3:
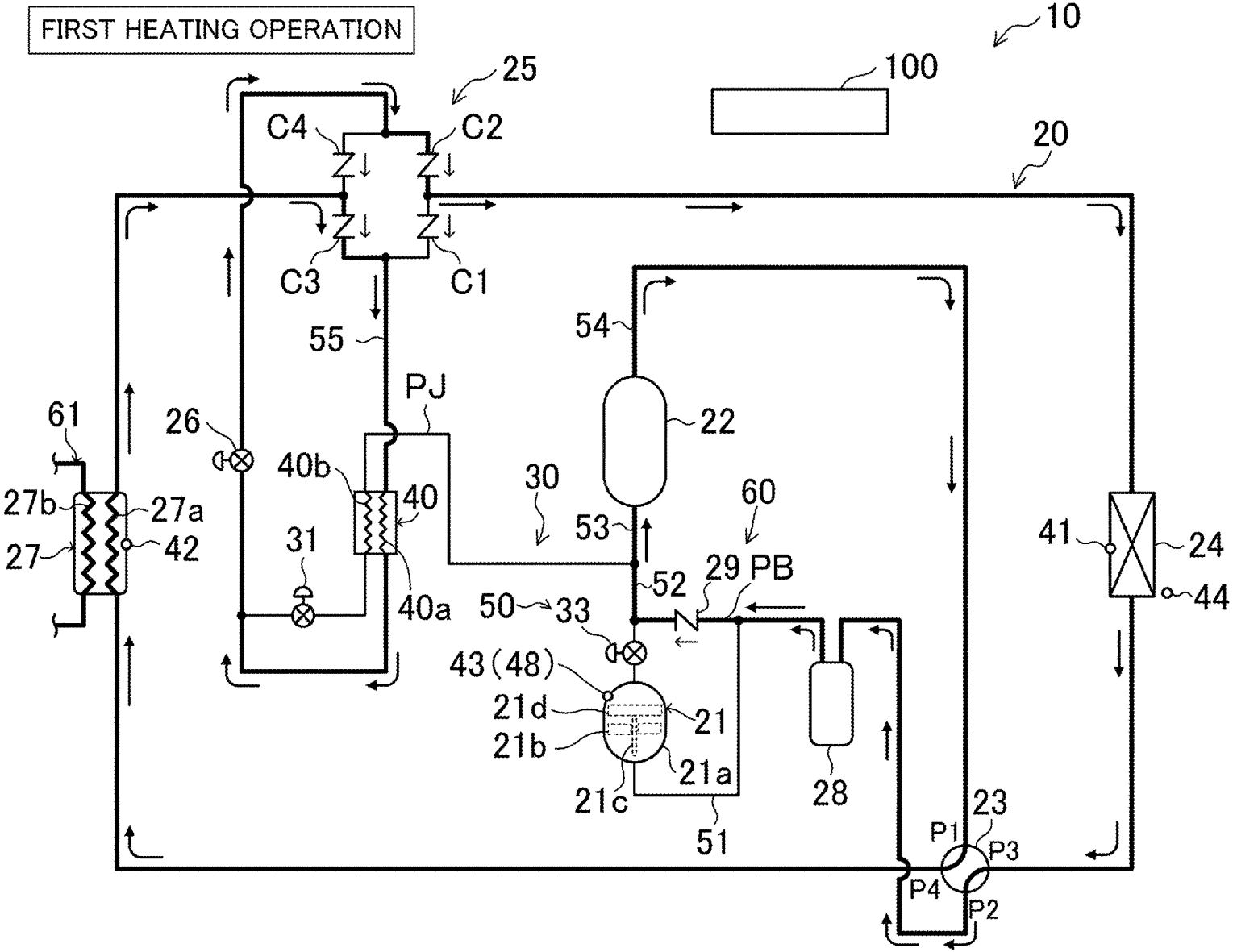
FIG. 3 corresponds to FIG. 1 and illustrates a flow of a refrigerant during a first heating operation.

As illustrated in FIG. 3, in the first heating operation, a refrigeration cycle in which the utilization-side heat exchanger (27) serves as a condenser (a radiator) and the heat-source-side heat exchanger (24) serves as an evaporator is performed. Specifically, the four-way switching valve (23) is placed in the first state. The opening degree of the expansion valve (26) is suitably adjusted. The injection expansion valve (31) is placed in a fully-closed state. The first compressor (21) is stopped, and the second compressor (22) is driven.

The refrigerant discharged from the second compressor (22) passes through the four-way switching valve (23), and dissipates heat to water to condense in the utilization-side heat exchanger (27). The refrigerant that has flowed out of the utilization-side heat exchanger (27) passes through the check-valve bridge (25), and flows through the main liquid pipe (55). The refrigerant flowing through the main liquid pipe (55) is decompressed at the expansion valve (26), passes through the check-valve bridge (25) again, and then evaporates in the heat-source-side heat exchanger (24). The refrigerant that has flowed out of the heat-source-side heat exchanger (24) passes through the four-way switching valve (23), the accumulator (28), and the bypass line (PB) in this order, and is sucked into the second compressor (22) so as to be compressed.

<Second Heating Operation>

Figure 4:
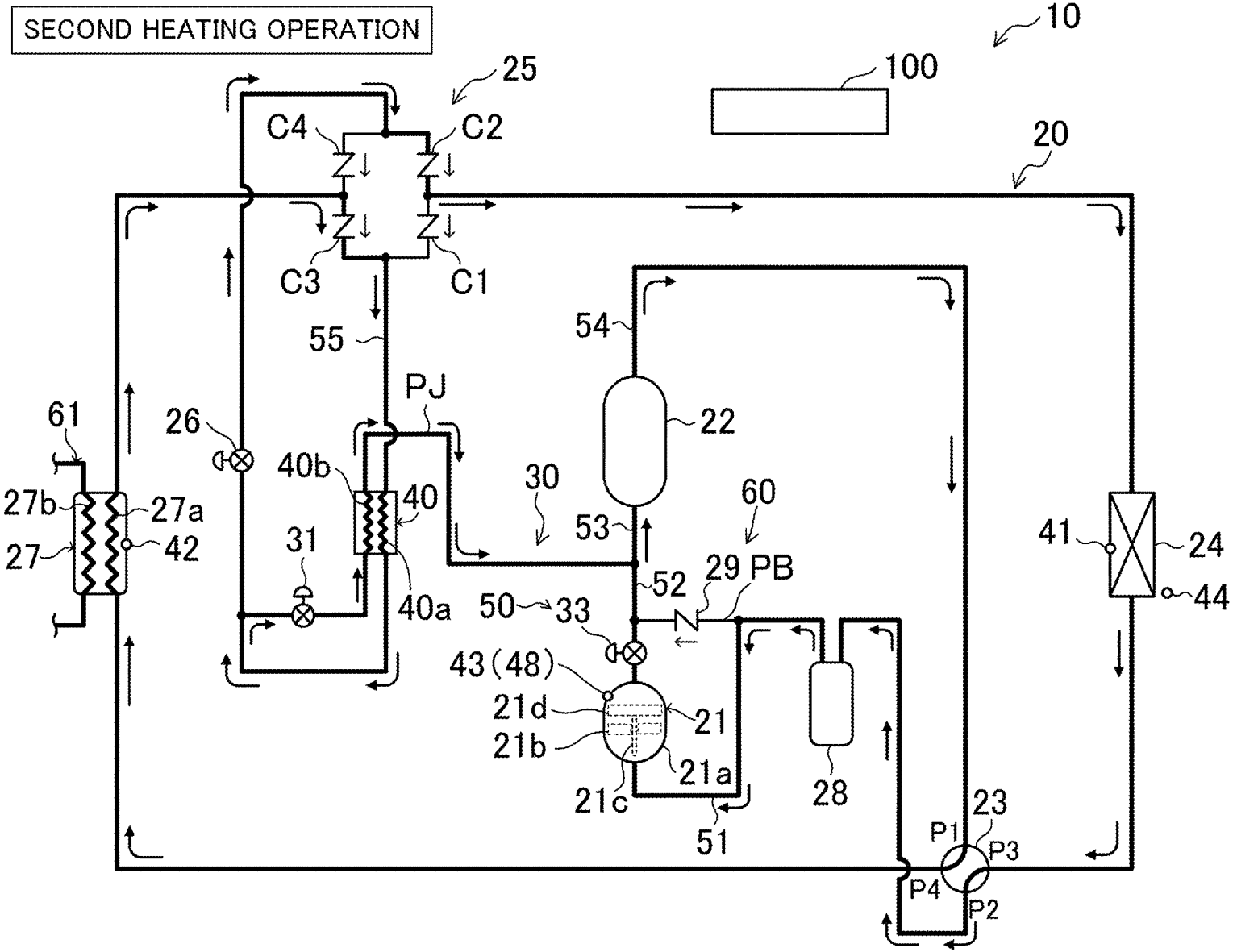
FIG. 4 corresponds to FIG. 1 and illustrates a flow of the refrigerant during a second heating operation.

As illustrated in FIG. 4, in the second heating operation, a refrigeration cycle in which the utilization-side heat exchanger (27) serves as a condenser (a radiator) and the heat-source-side heat exchanger (24) serves as an evaporator is performed. Specifically, the four-way switching valve (23) is placed in the first state. The opening degree of the expansion valve (26) and the opening degree of the injection expansion valve (31) are suitably adjusted. Both of the first and second compressors (21) and (22) are driven.

The refrigerant discharged from the second compressor (22) passes through the four-way switching valve (23), and dissipates heat to water to condense in the utilization-side heat exchanger (27). The refrigerant that has flowed out of the utilization-side heat exchanger (27) passes through the check-valve bridge (25), and circulates through the main liquid pipe (55). The refrigerant circulating through the main liquid pipe (55) dissipates heat to the refrigerant flowing through the fourth channel (40*b*) so as to be supercooled in the third channel (40*a*) of the intermediate heat exchanger (40). Thereafter, a portion of the refrigerant flowing through the main liquid pipe (55) flows into the injection line (PJ), and the remaining portion of the refrigerant is decompressed at the expansion valve (26) in the main liquid pipe (55).

The decompressed refrigerant passes through the check-valve bridge (25), and evaporates in the heat-source-side heat exchanger (24). The refrigerant that has flowed out of the heat-source-side heat exchanger (24) passes through the four-way switching valve (23) and the accumulator (28) in this order, and is sucked into the first compressor (21) so as to be compressed. The refrigerant discharged from the first compressor (21) is sucked into the second compressor (22) so as to be compressed.

Meanwhile, the refrigerant that has flowed into the injection line (PJ) is decompressed at the injection expansion valve (31), and absorbs heat from the refrigerant flowing through the third channel (40*a*) to evaporate in the fourth channel (40*b*) of the intermediate heat exchanger (40). Thereafter, the refrigerant flowing through the injection line (PJ) is introduced into the second suction pipe (53) for the second compressor (22).

<First Cooling Operation>

Figure 5:
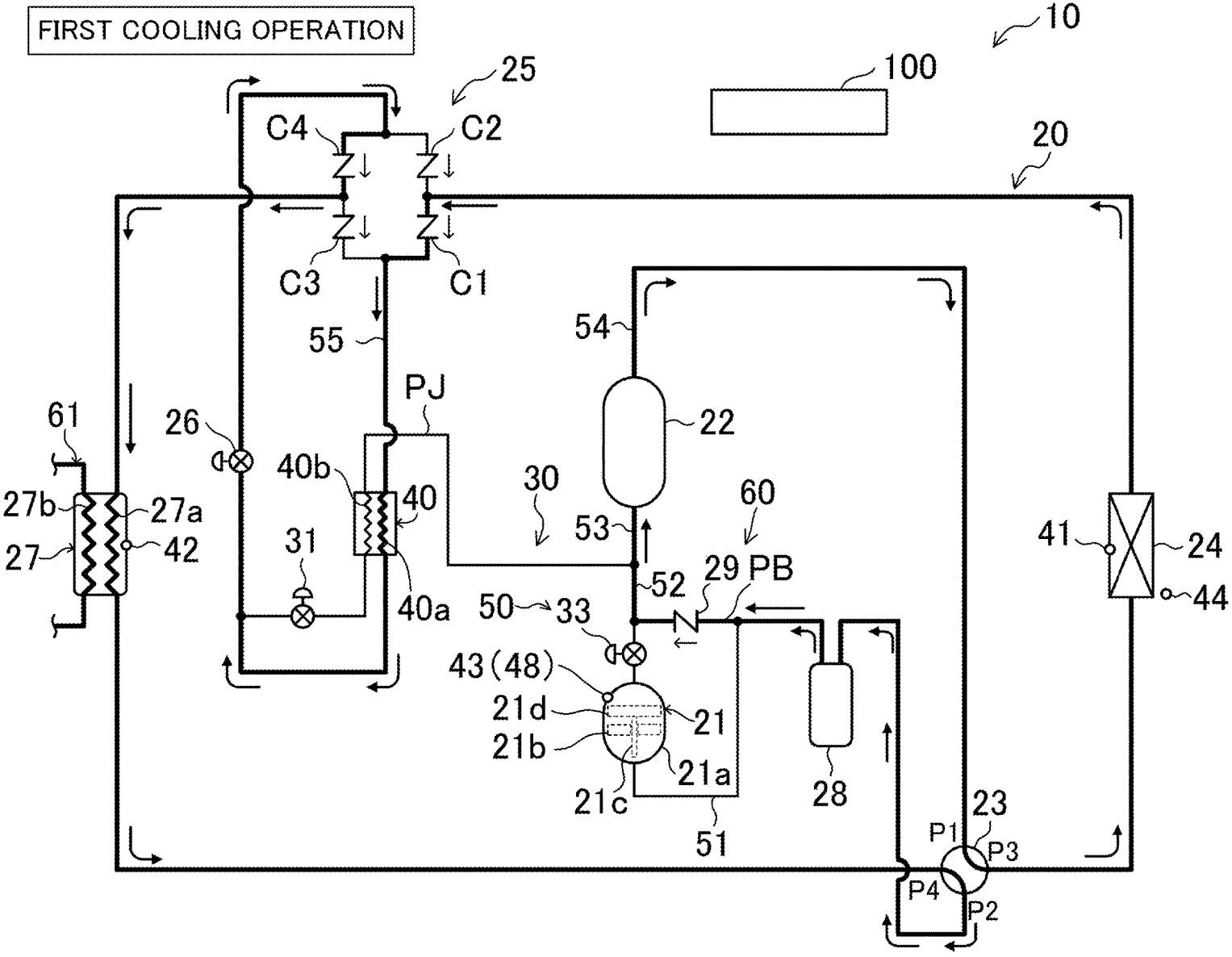
FIG. 5 corresponds to FIG. 1 and illustrates a flow of the refrigerant during a first cooling operation (a defrosting operation).

As illustrated in FIG. 5, in the first cooling operation, a refrigeration cycle in which the heat-source-side heat exchanger (24) serves as a condenser (a radiator) and the utilization-side heat exchanger (27) serves as an evaporator is performed. Specifically, the four-way switching valve (23) is placed in the second state. The opening degree of the expansion valve (26) is suitably adjusted. The injection expansion valve (31) is placed in the fully-closed state. The first compressor (21) is stopped, and the second compressor (22) is driven.

The refrigerant discharged from the second compressor (22) passes through the four-way switching valve (23), and condenses in the heat-source-side heat exchanger (24). The refrigerant that has flowed out of the heat-source-side heat exchanger (24) passes through the check-valve bridge (25), and flows through the main liquid pipe (55). The refrigerant flowing through the main liquid pipe (55) is decompressed at the expansion valve (26), passes through the check-valve bridge (25) again, and then absorbs heat from water to evaporate in the utilization-side heat exchanger (27). The refrigerant that has flowed out of the utilization-side heat exchanger (27) passes through the four-way switching valve (23), the accumulator (28), and the bypass line (PB) in this order, and is sucked into the second compressor (22) so as to be compressed.

<Second Cooling Operation>

Figure 6:
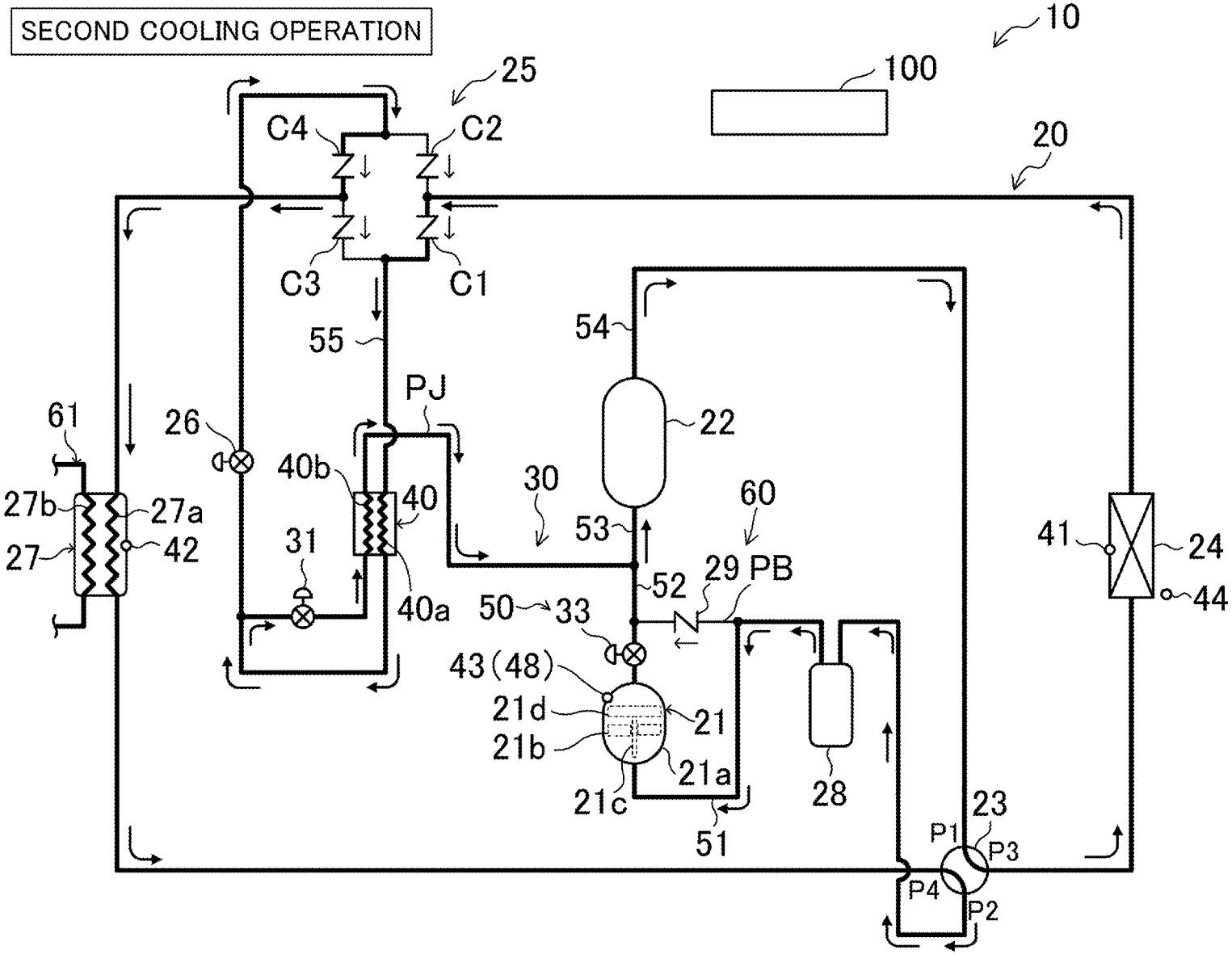
FIG. 6 corresponds to FIG. 1 and illustrates a flow of the refrigerant during a second cooling operation.

As illustrated in FIG. 6, in the second cooling operation, a refrigeration cycle in which the heat-source-side heat exchanger (24) serves as a condenser (a radiator) and the utilization-side heat exchanger (27) serves as an evaporator is performed. Specifically, the four-way switching valve (23) is placed in the second state. The opening degree of the expansion valve (26) and the opening degree of the injection expansion valve (31) are suitably adjusted. Both of the first and second compressors (21) and (22) are driven.

The refrigerant discharged from the second compressor (22) passes through the four-way switching valve (23), and condenses in the heat-source-side heat exchanger (24). The refrigerant that has flowed out of the heat-source-side heat exchanger (24) passes through the check-valve bridge (25), and circulates through the main liquid pipe (55). The refrigerant circulating through the main liquid pipe (55) dissipates heat to the refrigerant flowing through the fourth channel (40*b*) so as to be supercooled in the third channel (40*a*) of the intermediate heat exchanger (40). Thereafter, a portion of the refrigerant flowing through the main liquid pipe (55) flows into the injection line (PJ), and the remaining portion of the refrigerant is decompressed at the expansion valve (26) in the main liquid pipe (55).

The decompressed refrigerant passes through the check-valve bridge (25), and absorbs heat from water to evaporate in the utilization-side heat exchanger (27). The refrigerant that has flowed out of the utilization-side heat exchanger (27) passes through the four-way switching valve (23) and the accumulator (28) in this order, and is sucked into the first compressor (21) so as to be compressed. The refrigerant discharged from the first compressor (21) is sucked into the second compressor (22) so as to be compressed.

Meanwhile, the refrigerant that has flowed into the injection line (PJ) is decompressed at the injection expansion valve (31), and absorbs heat from the refrigerant flowing through the third channel (40*a*) to evaporate in the fourth channel (40*b*) of the intermediate heat exchanger (40). Thereafter, the refrigerant flowing through the injection line (PJ) is introduced into the second suction pipe (53) for the second compressor (22).

<Defrosting Operation>

As illustrated in FIG. 5, in the defrosting operation, the same actions as those in the first cooling operation are performed. In the defrosting operation, a refrigeration cycle in which the heat-source-side heat exchanger (24) serves as a condenser (a radiator), and the utilization-side heat exchanger (27) serves as an evaporator is performed. As a result, frost on the surface of the heat-source-side heat exchanger (24) is heated from inside. The refrigerant used to defrost the heat-source-side heat exchanger (24) evaporates in the utilization-side heat exchanger (27), is then sucked into the first compressor (21), and is compressed again.

Problems in First Operation

While the refrigeration apparatus (10) is performing the first heating operation, the internal temperature of the stopped first compressor (21) is substantially equal to the outdoor air temperature. In a normal operating state, the outdoor air temperature is higher than the evaporation temperature of the heat-source-side heat exchanger (24). Thus, the evaporation pressure of the heat-source-side heat exchanger (24) is lower than the internal pressure of the first compressor (21) at rest. This allows the refrigerant circulating through the bypass line (PB) to flow into the suction side of the second compressor (22) that is being driven, and makes it difficult for the refrigerant to flow into the discharge side of the first compressor (21) at rest.

Figure 7:
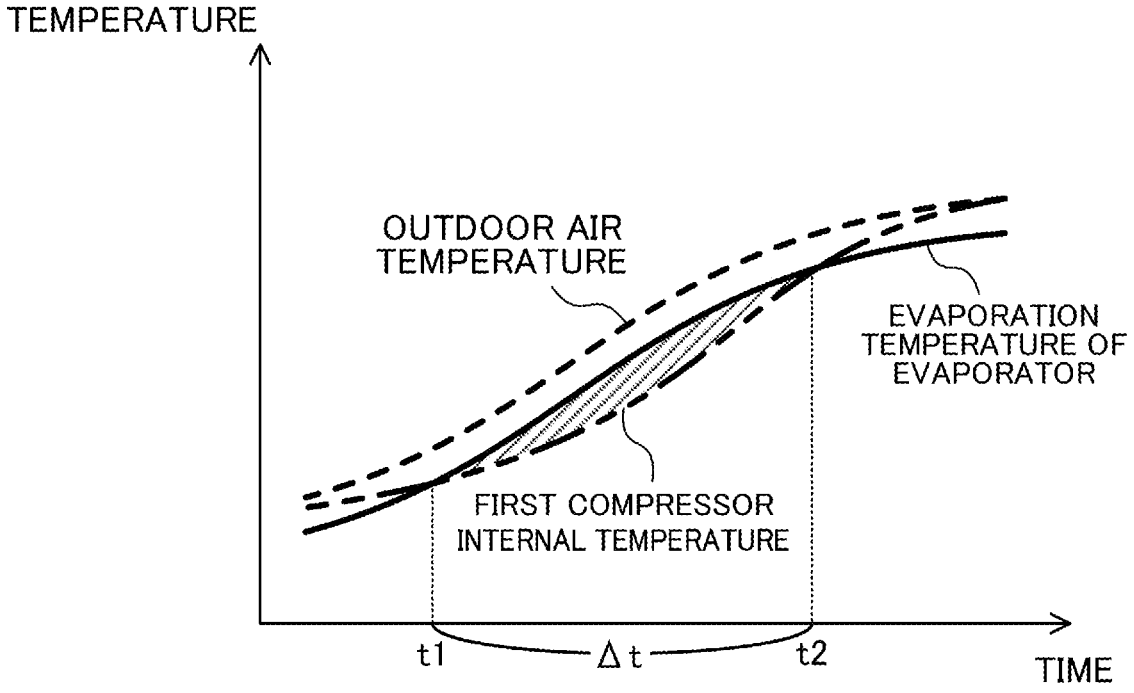
FIG. 7 is a graph showing the relationship between temperature and time and indicating that a first condition is satisfied.

However, as illustrated in FIG. 7, in the first heating operation, for example, if the outdoor air temperature suddenly rises by sudden solar radiation in the early hours of the morning when the outdoor air temperature is extremely low, the evaporation pressure of the heat-source-side heat exchanger (24) suddenly rises. In contrast, it takes time to increase the internal temperature of the first compressor (21) at rest to substantially the same outdoor air temperature, under the influence of the heat capacity of the first compressor (21). Meanwhile, the internal temperature of the first compressor (21) may become lower than the evaporation temperature of the heat-source-side heat exchanger (24). FIG. 7 shows a state where during the period Δt from the time t1 to the time t2, the evaporation temperature Te1 of the heat-source-side heat exchanger (24) is higher than the internal temperature Th1 of the first compressor (21).

This state causes the internal pressure of the first compressor (21) to be lower than the evaporation pressure of the heat-source-side heat exchanger (24). As a result, a portion of the refrigerant circulating through the bypass line (PB) flows into the discharge side of the first compressor (21) with a lower pressure. The refrigerant flowing into the first compressor (21) at rest causes the amount of the refrigerant in the entire refrigerant circuit (20) to be insufficient, resulting in a decrease in the capacity of the refrigeration apparatus (10). If the first compressor (21) is driven during the first heating operation (if a shift is made to the second heating operation), lubrication of the compression mechanism (21*d*) of the first compressor (21) is impaired, resulting in a decrease in the reliability of the first compressor (21).

A similar phenomenon may occur also in the defrosting operation. The defrosting operation performed at a very low temperature causes the refrigerant that has dissipated heat in the heat-source-side heat exchanger (24) to be decompressed at the expansion valve (26) to evaporate in the utilization-side heat exchanger (27). The evaporation temperature of the utilization-side heat exchanger (27) at this time is transitionally higher than the internal temperature of the first compressor (21). Thus, during the defrosting operation (first cooling operation), the refrigerant flows into the first compressor (21).

In consideration of such a problem, the refrigeration apparatus (10) of this embodiment reduces the refrigerant flowing into the first compressor (21) while a first condition where the internal pressure of the first compressor (21) at rest during the first operation is lower than the evaporation pressure of the heat exchanger (24, 27) functioning as an evaporator is satisfied. Specifically, while the first condition is satisfied, the reduction mechanism (50) keeps the refrigerant that has flowed out of the bypass line (PB) from flowing into the discharge side of the first compressor (21).

Figure 8:
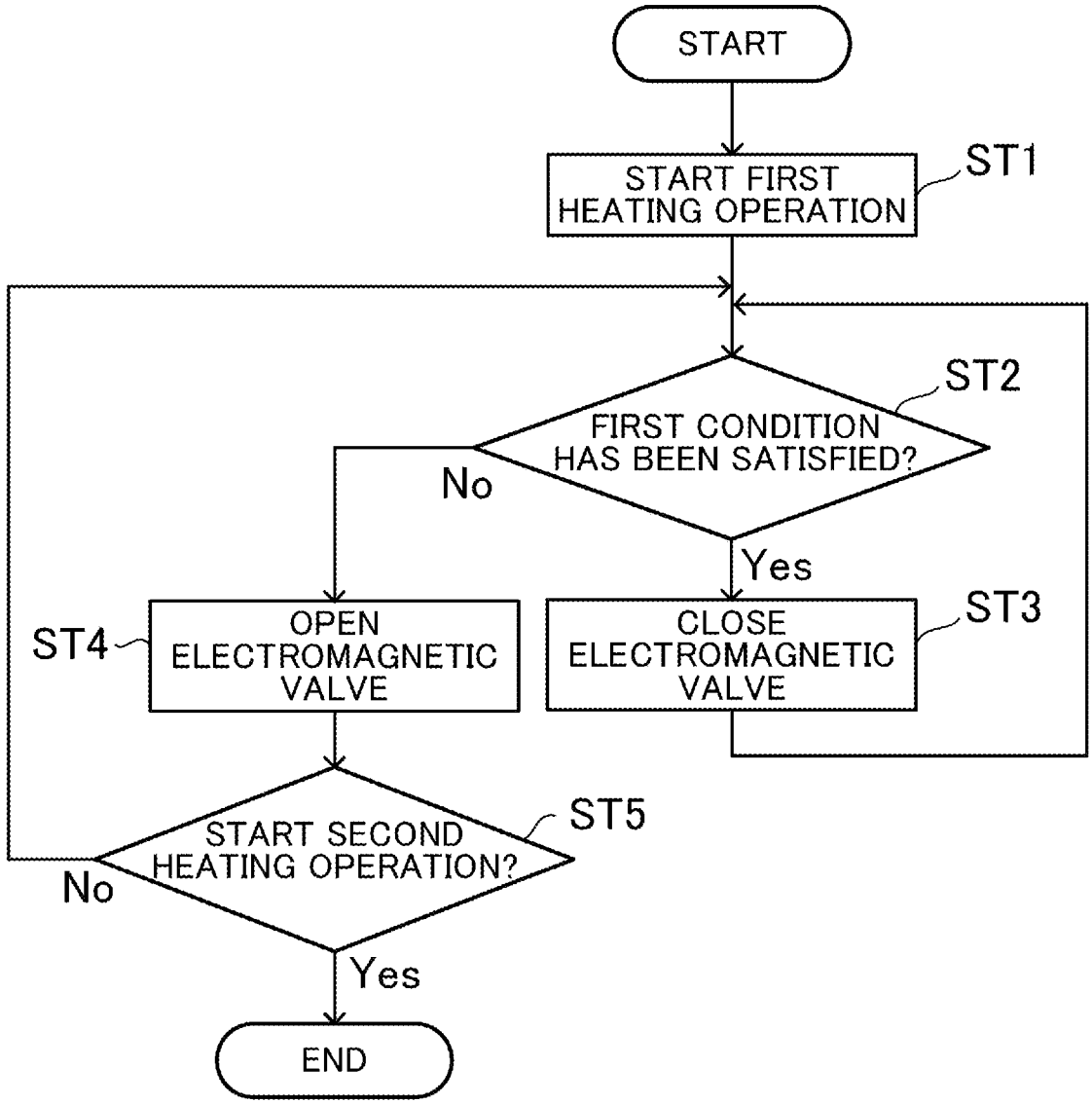
FIG. 8 is a flowchart of actions to be performed by the control unit in the first heating operation.

Actions performed by the reduction mechanism (50) in the first heating operation will be specifically described with reference to FIG. 8.

In Step ST1, the control unit (100) starts the first heating operation. Specifically, the control unit (100) switches the four-way switching valve (23) to the first state. The control unit (100) makes the first compressor (21) inactive, and drives the second compressor (22). The control unit (100) suitably adjusts the opening degree of the expansion valve (26), and places the injection expansion valve (31) in the fully-closed state. When the first heating operation is started, Step ST2 is performed.

In Step ST2, the control unit (100) determines whether or not the first condition has been satisfied. The first condition is a condition indicating that the internal pressure of the first compressor (21) is lower than the evaporation pressure of the heat-source-side heat exchanger (24). Here, the relationship between the internal pressure of the first compressor (21) and the evaporation pressure of the heat-source-side heat exchanger (24) is correlated with the relationship between the internal temperature of the first compressor (21) and the evaporation temperature of the heat-source-side heat exchanger (24). For this reason, if the internal temperature Th1 of the first compressor (21) is lower than the evaporation temperature Te1 of the heat-source-side heat exchanger (24), the control unit (100) assumes that the first condition has been satisfied. If a determination is made that the first condition has been satisfied, Step ST3 is performed. If a determination is made that the first condition has not been satisfied, Step ST4 is performed.

In Step ST3, the reduction mechanism (50) is activated. Specifically, the control unit (100) places the electromagnetic valve (33) in the closed state. The electromagnetic valve (33) placed in the closed state isolates the discharge side of the first compressor (21) from the suction side of the second compressor (22) and the outlet end of the bypass line (PB). This can keep the refrigerant that has flowed out of the bypass line (PB) from being sucked into the first compressor (21) under a condition where the first condition is satisfied. After Step ST3 has been performed, Step ST2 is performed again.

In Step ST4, the reduction mechanism (50) is deactivated. Specifically, the control unit (100) places the electromagnetic valve (33) in the open state. After Step ST4 has been performed, Step ST5 is performed.

In Step ST5, the control unit (100) determines whether or not the second heating operation is to be started. If a determination is made that the second heating operation is not to be started, the first heating operation is continued, and Step ST2 is performed again. If a determination is made that the second heating operation is to be started, the control unit (100) drives the first compressor (21).

Figure 9:
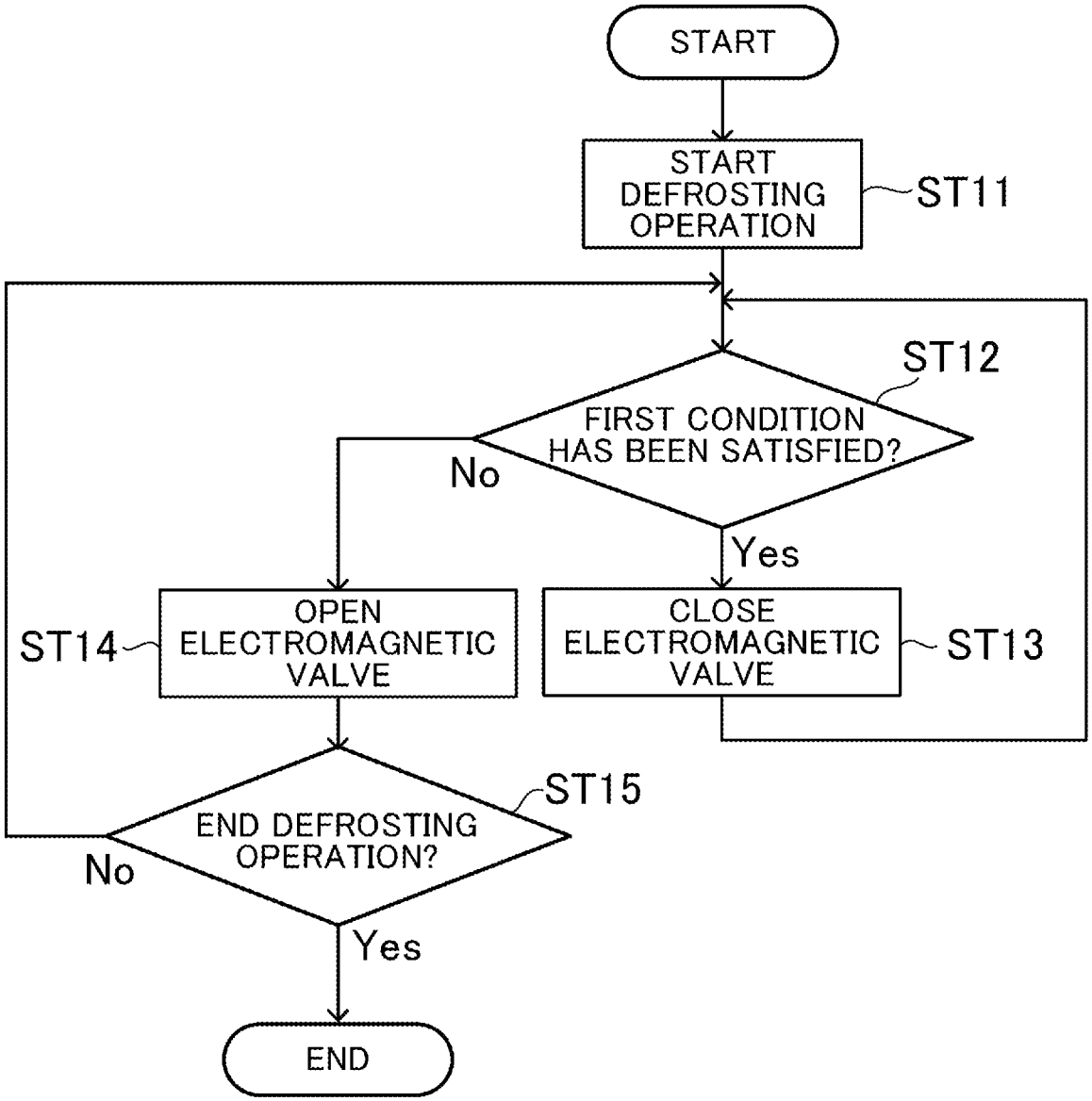
FIG. 9 is a flowchart of actions to be performed by the control unit in the defrosting operation.

Next, actions performed by the reduction mechanism (50) in the defrosting operation will be specifically described with reference to FIG. 9.

In Step ST11, the control unit (100) starts the defrosting operation, which is the first cooling operation. Specifically, the control unit (100) switches the four-way switching valve (23) to the second state. The control unit (100) makes the first compressor (21) inactive, and drives the second compressor (22). The control unit (100) suitably adjusts the opening degree of the expansion valve (26), and places the injection expansion valve (31) in the fully-closed state. When the defrosting operation is started, Step ST12 is performed.

In Step ST12, the control unit (100) determines whether or not the first condition has been satisfied. Just like Step ST2 described above, if the internal temperature Th1 of the first compressor (21) is lower than the evaporation temperature Te2 of the utilization-side heat exchanger (27), the control unit (100) assumes that the first condition has been satisfied. If a determination is made that the first condition has been satisfied, Step ST13 is performed. If a determination is made that the first condition has not been satisfied, Step ST14 is performed.

In Step ST13, the reduction mechanism (50) is activated. Specifically, the control unit (100) places the electromagnetic valve (33) in the closed state. After Step ST13 has been performed, Step ST12 is performed again.

In Step ST14, the reduction mechanism (50) is deactivated. Specifically, the control unit (100) places the electromagnetic valve (33) in the open state. After Step ST14 has been performed, Step ST15 is performed.

In Step ST15, the control unit (100) determines whether or not the defrosting operation is to be ended. If a determination is made that the defrosting operation is not to be ended, the defrosting operation is continued, and Step ST12 is performed again. If a determination is made that the defrosting operation is to be ended, this flow ends.

Advantages of Embodiment

In the feature (1) of the embodiment, the refrigeration apparatus (10) includes the reduction mechanism (50) configured to reduce the refrigerant flowing into the first compressor (21) while the first condition is satisfied. The first condition indicates that the internal pressure of the first compressor (21) is lower than the evaporation pressure of the evaporator (24, 27) in the first operation of performing the refrigeration cycle in which the first compressor (21) is stopped and the second compressor (22) is driven.

According to the feature (1) of the embodiment, while the first condition is satisfied in the first heating operation, the refrigerant circulating through the bypass line (PB) is kept from flowing into the discharge side of the first compressor (21). Since the refrigerant flowing into the first compressor (21) at rest is reduced, the amount of the refrigerant can be kept from being insufficient during the first operation. As a result, during the first heating operation, for example, even if the outdoor air temperature suddenly rises by sudden solar radiation in the early hours of the morning when the outdoor air temperature is extremely low, a decrease in the capacity of the refrigeration apparatus (10) can be reduced.

In addition, since the refrigerant flowing into the first compressor (21) at rest is reduced, oil in the first compressor (21) at rest can be kept from being dissolved in the refrigerant. As a result, when the second heating operation is started subsequently to the first heating operation, lubrication of the compression mechanism (21*d*) in the first compressor (21) can be kept from being impaired.

In the feature (2) of the embodiment, the first condition is a condition where the internal temperature of the first compressor (21) is lower than the evaporation temperature of the heat-source-side heat exchanger (24) (an evaporator).

According to the feature (2) of the embodiment, detecting the internal temperature Th1 of the first compressor (21) and the evaporation temperature Te1 of the heat-source-side heat exchanger (24) allows whether or not the first condition is satisfied to be determined.

In the feature (3) of the embodiment, the internal temperature sensor (43) detects the temperature of the outer surface of the casing (21*a*) of the first compressor (21), and the internal temperature of the first compressor (21) is a value based on the detection value detected by the internal temperature sensor (43).

According to the feature (3) of the embodiment, the internal temperature Th1 of the first compressor (21) can be estimated based on the detection value detected by the internal temperature sensor (43).

In the feature (4) of the embodiment, the reduction mechanism (50) includes the electromagnetic valve (33) (a valve) connected between the first compressor (21) and the outlet end of the bypass line (PB), and the electromagnetic valve (33) is closed while the first condition is satisfied.

According to the feature (4) of the embodiment, while the first condition is satisfied, the control unit (100) places the electromagnetic valve (33) in the closed state. This can reduce the refrigerant flowing from the bypass line (PB) into the first compressor (21) while the first condition is satisfied.

First Variation of First Embodiment

Figure 10:
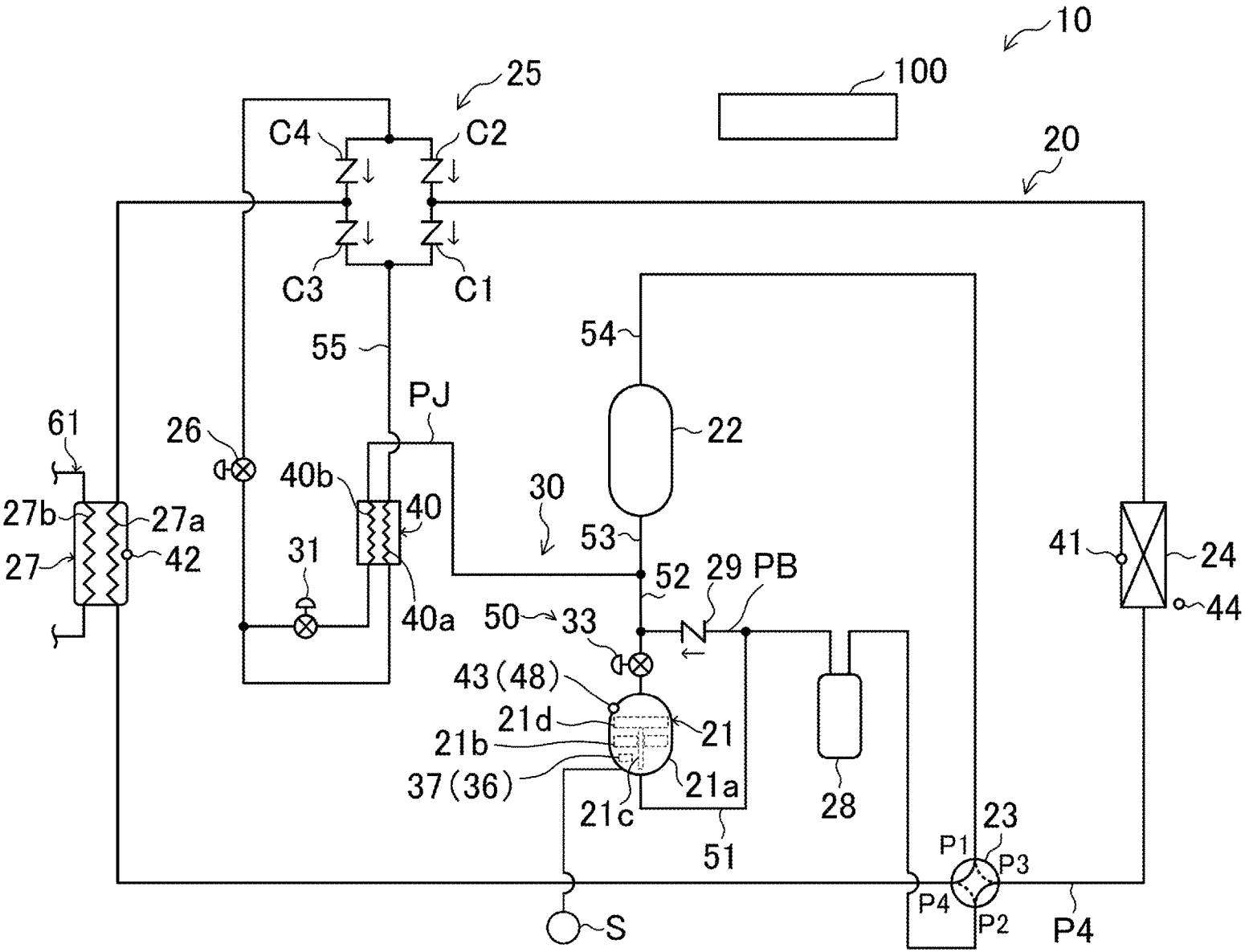
FIG. 10 corresponds to FIG. 1 and illustrates a refrigeration apparatus according to a first variation.

As illustrated in FIG. 10, a first compressor (21) of a refrigeration apparatus (10) according to a first variation of the first embodiment includes a heater (37), and the refrigeration apparatus (10) may not include an electromagnetic valve (33). The heater (37) is disposed in an oil reservoir (not shown) of the casing (21*a*). The oil reservoir is formed at the bottom of the casing (21*a*). The heater (37) is an electric heater that generates heat by being energized by a power source (S). The heater (37) heats the oil reservoir to keep oil from being dissolved in the refrigerant.

Figure 11:
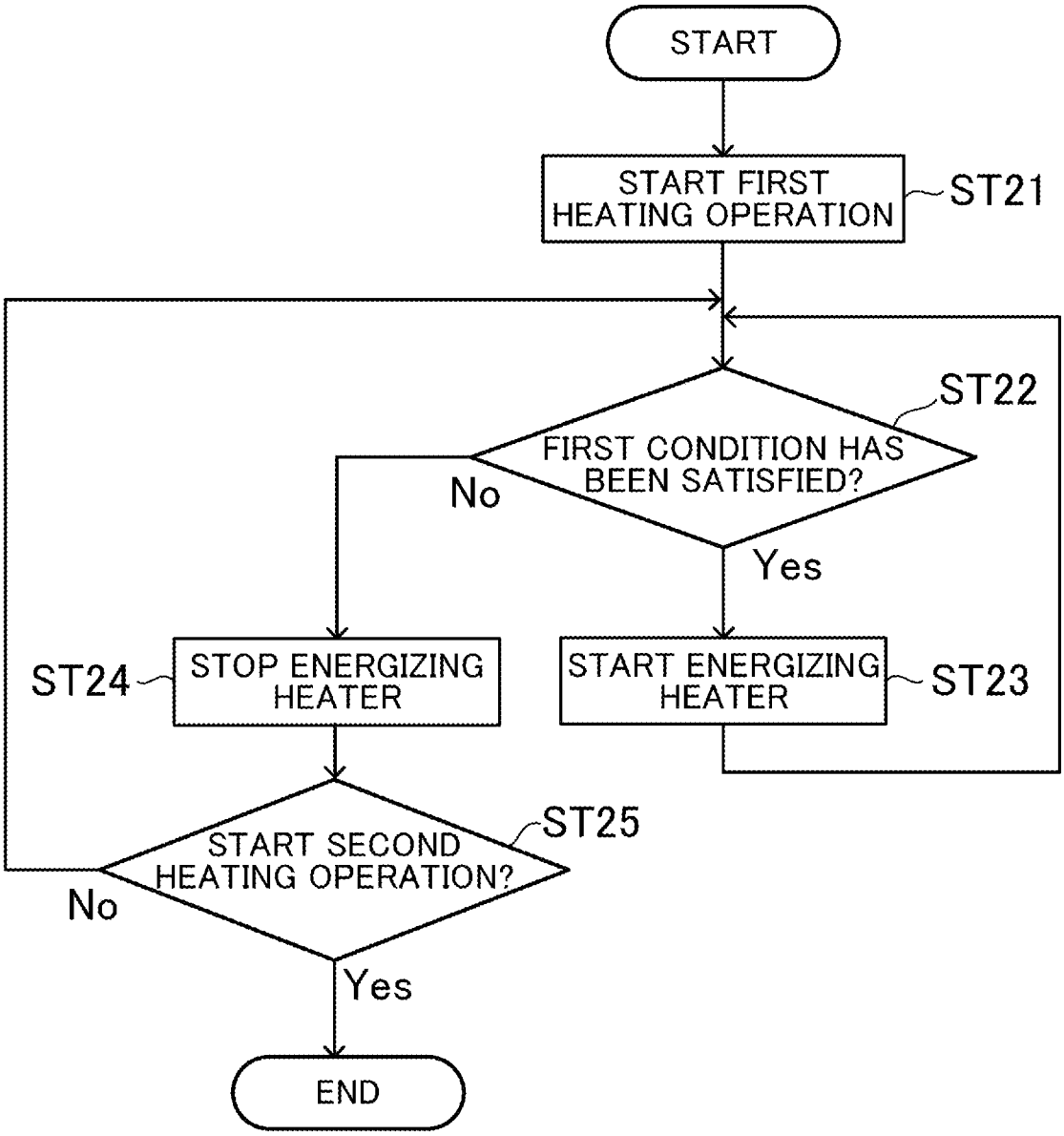
FIG. 11 is a flowchart of actions performed by a control unit of the refrigeration apparatus according to the first variation.

In this variation, a reduction mechanism (50) includes the heater (37) and a control unit (100). The heater (37) corresponds to a heating section (36). The heater (37) heats the first compressor (21) when the first condition is satisfied. Specifically, the heater (37) energized by the control unit (100) generates heat to heat the inside of the first compressor (21). Actions performed by the reduction mechanism (50) according to a first variation will be described with reference to FIG. 11.

In Step ST21, the control unit (100) performs an action identical to or similar to that in Step ST1 of the first embodiment.

In Step ST22, just like Step ST2 of the first embodiment, the control unit (100) determines whether or not the first condition has been satisfied. If a determination is made that the first condition has been satisfied, Step ST23 is performed. If a determination is made that the first condition has not been satisfied, Step ST24 is performed.

In Step ST23, the reduction mechanism (50) is activated. Specifically, the control unit (100) energizes the heater (37). The energized heater (37) generates heat to heat the inside of the first compressor (21). After Step ST23 has been performed, Step ST22 is performed again.

In Step ST24, the reduction mechanism (50) is deactivated. Specifically, the control unit (100) stops energizing the heater (37).

In Step ST25, the control unit (100) determines whether or not the second heating operation is to be started. If a determination is made that the second heating operation is not to be started, the first heating operation is continued, and Step ST22 is performed again. If a determination is made that the second heating operation is to be started, the control unit (100) drives the first compressor (21).

According to this variation, if the first condition is satisfied during the first operation, heat generated by the heater (37) increases the internal temperature of the first compressor (21). This can keep the internal temperature Th1 of the first compressor (21) from falling below the evaporation temperature Te1 of the heat-source-side heat exchanger (24) functioning as an evaporator. As a result, the refrigerant flowing into the first compressor (21) during the first operation can be reduced.

In addition, the heater (37) can be used both to heat the oil reservoir and for the reduction mechanism (50). The refrigeration apparatus (10) does not need to be provided with a member such as the electromagnetic valve (33) of the first embodiment as the reduction mechanism (50). This can keep the manufacturing cost of the refrigeration apparatus (10) from increasing.

In addition, only while the first condition is satisfied, the heater (37) needs to be energized. This can reduce an increase in the amount of power used, and can keep the cost of usage of the refrigeration apparatus (10) from increasing.

Second Variation of First Embodiment

Figure 12:
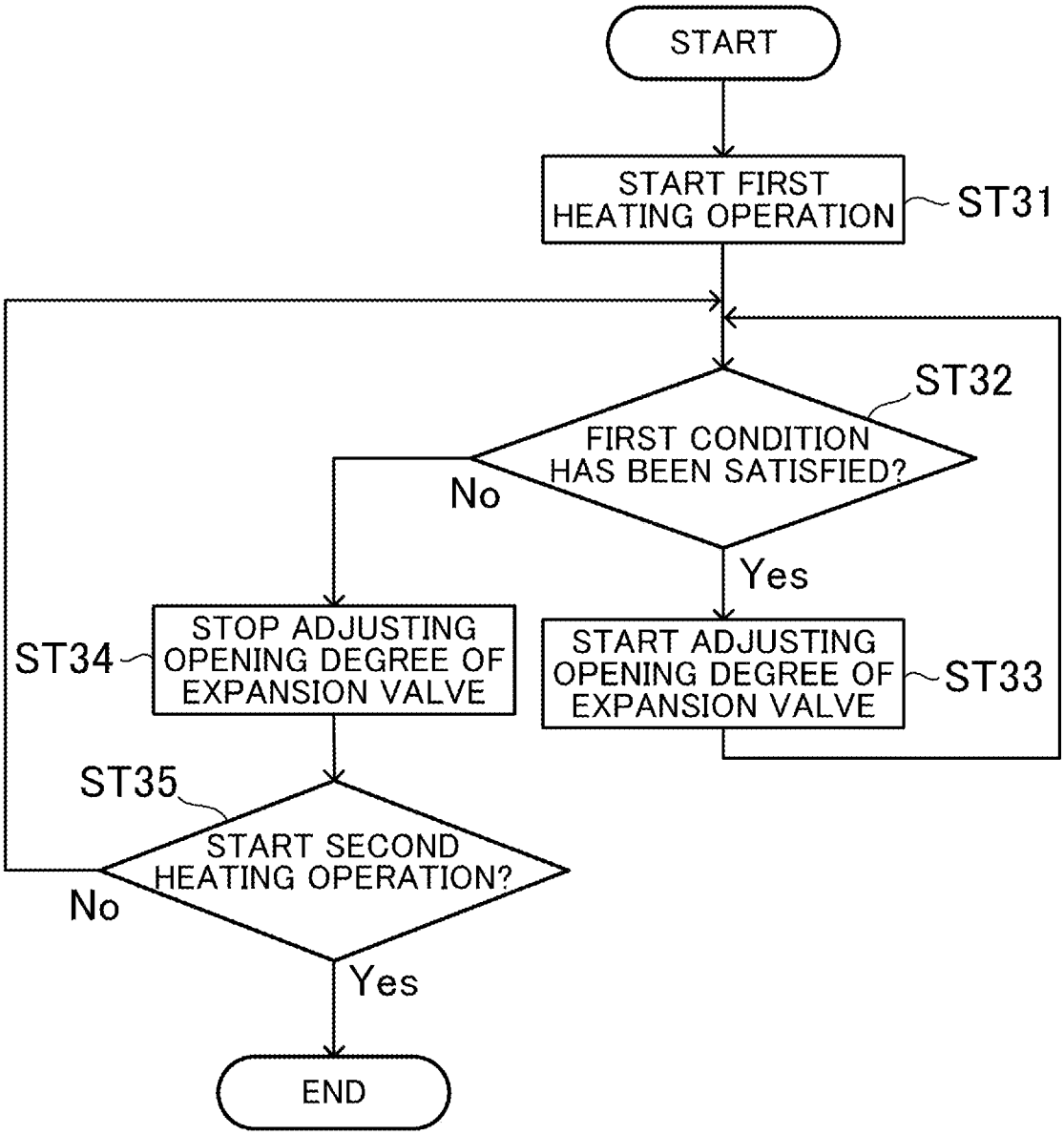
FIG. 12 is a flowchart of actions performed by a control unit of a refrigeration apparatus according to a second variation.

The refrigeration apparatus (10) according to a second variation of the first embodiment does not include an electromagnetic valve (33). In this variation, a reduction mechanism (50) includes an expansion valve (26) and a control unit (100). The expansion valve (26) corresponds to a decompression mechanism. When the first condition is satisfied, the evaporation pressure of an evaporator is lowered. Actions performed by the control unit (100) according to this variation will be described with reference to FIG. 12.

In Step ST31, the control unit (100) performs an action identical to or similar to that in Step ST1 of the first embodiment.

In Step ST32, just like Step ST2 of the first embodiment, the control unit (100) determines whether or not the first condition has been satisfied. If a determination is made that the first condition has been satisfied, Step ST33 is performed. If a determination is made that the first condition has not been satisfied, Step ST34 is performed.

In Step ST33, the reduction mechanism (50) is activated. Specifically, the control unit (100) decompresses the refrigerant by adjusting and reducing the opening degree of the expansion valve (26). After Step ST33 has been performed, Step ST32 is performed again.

In Step ST34, the reduction mechanism (50) is deactivated. Specifically, the control unit (100) stops adjusting the opening degree of the expansion valve (26). After Step ST34, Step ST35 is performed.

In Step ST35, the control unit (100) determines whether or not the second heating operation is to be started. If a determination is made that the second heating operation is not to be started, the first heating operation is continued, and Step ST32 is performed again. If a determination is made that the second heating operation is to be started, the control unit (100) drives the first compressor (21).

According to this variation, when the first condition is satisfied, the control unit (100) adjusts and reduces the opening degree of the expansion valve (26). Thus, the refrigerant is decompressed, and the evaporation temperature Te1 of the heat-source-side heat exchanger (24) decreases. A decrease in the evaporation temperature Te1 lowers the evaporation pressure of the heat-source-side heat exchanger (24). As a result, the evaporation pressure can be made lower than the internal pressure of the first compressor (21). This can reduce the refrigerant flowing into the first compressor (21) during the first operation.

In addition, the expansion valve (26) can be used both for a refrigeration cycle operation of the refrigeration apparatus (10) and for the reduction mechanism (50). Thus, the refrigeration apparatus (10) does not need to be provided with a member such as the electromagnetic valve (33) of the first embodiment as the reduction mechanism (50). This can keep the manufacturing cost of the refrigeration apparatus (10) from increasing.

Other Embodiments

The above embodiment may also be configured as follows.

Figure 13:
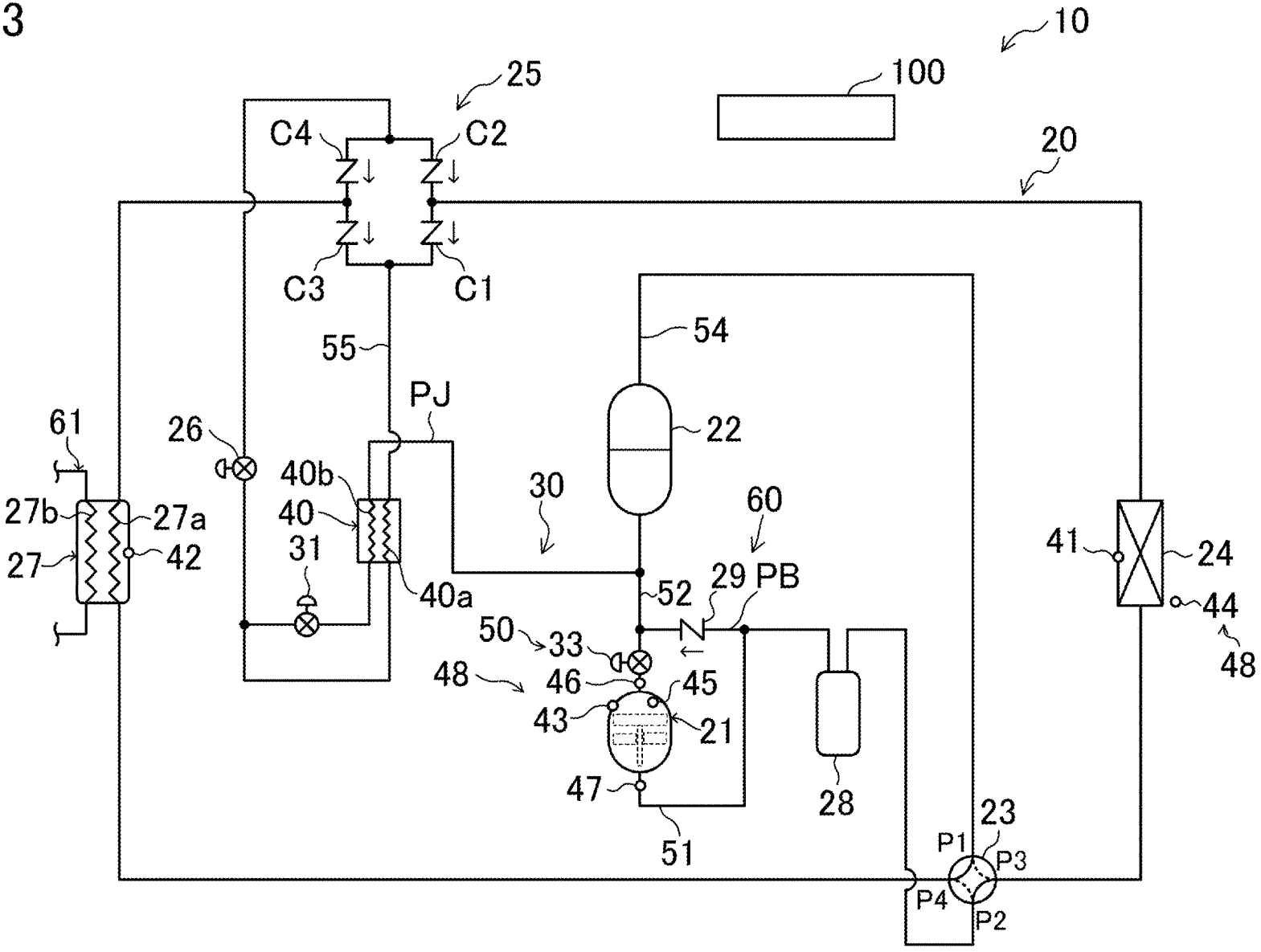
FIG. 13 corresponds to FIG. 1 and illustrates the arrangement of a first temperature sensor of a refrigeration apparatus according to another embodiment.

As illustrated in FIG. 13, the first temperature sensor (48) of the refrigeration apparatus (10) may be at least one of an internal temperature sensor (43), an inside temperature sensor (45), a suction pipe temperature sensor (47), or an outdoor air temperature sensor (44).

The inside temperature sensor (45) is disposed inside the casing (21*a*). The inside temperature sensor (45) detects the temperature inside the casing (21*a*). The suction pipe temperature sensor (47) is connected to the first suction pipe (51). The suction pipe temperature sensor (47) detects the temperature of the first suction pipe (51). The discharge pipe temperature sensor (46) is connected to the first discharge pipe (52). The discharge pipe temperature sensor (46) detects the temperature of the first discharge pipe (52).

In other words, the first temperature sensor (48) may detect the temperature of at least one of the outer surface of the casing (21*a*) of the first embodiment, the interior of the casing (21*a*), the first suction pipe (51), the first discharge pipe (52), or outdoor air. The internal temperature of the first compressor (21) is based on the detection value detected by the first temperature sensor (48).

The heating section (36) may be a motor (21*b*) provided in the first compressor (21). The motor (21*b*) is energized under an open-phase condition while the first condition is satisfied. The energization under the open-phase condition refers to, for example, an energized state in which one or more phases of the three-phase power source S do not operate. This results in a state where the motor (21*b*) is not driven but is energized. If this state continues, a coil of the motor (21*b*) generates heat, leading to a rise in the internal temperature of the first compressor (21). This can keep the internal temperature of the first compressor (21) from falling below the evaporation temperature of the evaporator (24, 27). As a result, the refrigerant flowing into the first compressor (21) during the first operation can be reduced.

The control unit (100) may include a refrigerant pressure sensor (not shown) configured to detect the evaporation pressure of the refrigerant circuit (20), and an internal pressure sensor (not shown) configured to detect the internal pressure of the first compressor (21). During the first operation, if a pressure value detected by the internal pressure sensor falls below a value of the evaporation pressure detected by the refrigerant pressure sensor, the control unit (100) can determine that the first condition has been satisfied. Since the evaporation pressure of the evaporator and the internal pressure of the first compressor (21) are directly detected, the evaporation pressure can be reliably kept from exceeding the internal pressure.

The control unit (100) may determine the pressure of the evaporator based on the temperature detected by the first temperature sensor (48). Specifically, the control unit (100) may determine the evaporation pressure of the heat-source-side heat exchanger (24) based on the saturation pressure corresponding to the temperature detected by the first refrigerant temperature sensor (41). The control unit (100) may determine the evaporation pressure of the utilization-side heat exchanger (27) based on the saturation pressure corresponding to the temperature detected by the second refrigerant temperature sensor (42). The control unit (100) may determine a value of the internal pressure of the first compressor (21) based on data (information) indicating the relationship between the internal temperature of the first compressor (21) and the internal pressure of the first compressor (21).

The reduction mechanism (50) may be activated before the satisfaction of the first condition. In this case, the control unit (100) forecasts the evaporation temperature of the evaporator and the internal temperature of the first compressor (21) based on, for example, the degree to which the outdoor air temperature increases, and estimates whether or not the first condition is satisfied. For example, in FIG. 7, if it is estimated that the first condition is satisfied at time t1, the reduction mechanism (50) is activated before time t1. This can reliably reduce the refrigerant flowing into the first compressor (21) at the point in time (time t1) when the first condition is satisfied.

The reduction mechanism (50) may be activated during the period Δt during which the first condition is satisfied or during a portion of the satisfaction period Δt. If the reduction mechanism (50) is activated during the period Δt, the refrigerant flowing into the first compressor (21) can be reliably reduced.

The reduction mechanism (50) may continue to be activated even after the period Δt (after time t2). This can reliably reduce the refrigerant flowing into the first compressor (21).

The valve (33) may be a flow rate control valve or an expansion valve.

The decompression mechanism (26) may be an expander, a capillary tube, or any other similar mechanism. If the decompression mechanism (26) is a capillary tube, the main liquid pipe (55) of the refrigerant circuit (20) is provided with a valve (not shown) and a branch line (not shown) bypassing the valve. The capillary tube is connected to the branch line.

The first and second compressors (21) and (22) may be other types of compressors, such as a rotary compressor, a rolling piston compressor, a turbo compressor, or a screw compressor.

In the refrigerant circuit (20), a compressor may be further connected to the discharge side of the second compressor (22). In other words, the refrigerant circuit (20) may include three or more compressors, and may perform a multi-stage compression refrigeration cycle.

While the embodiments and variations thereof have been described above, it will be understood that various changes in form and details may be made without departing from the spirit and scope of the claims. The embodiments and the variations thereof may be combined and replaced with each other without deteriorating intended functions of the present disclosure. The expressions of "first," "second," . . . described above are used to distinguish the terms to which these expressions are given, and do not limit the number and order of the terms.

INDUSTRIAL APPLICABILITY

As can be seen from the foregoing description, the present disclosure is useful for a refrigeration apparatus.

Explanation of References

10 Refrigeration Apparatus
20 Refrigerant Circuit
21 First Compressor
21*a* Casing
21*b* Motor
22 Second Compressor
26 Expansion Valve (Decompression Mechanism)
33 Electromagnetic Valve (Valve)
36 Heating Section
37 Heater
48 First Temperature Sensor
50 Reduction Mechanism
51 First Suction Pipe (Suction Line)
52 First Discharge Pipe (Discharge Line)

The invention claimed is:

1. A refrigeration apparatus, comprising:

a refrigerant circuit including a first compressor, a second compressor connected to a discharge side of the first compressor, and an evaporator, the refrigerant circuit being switchable between a first operation of performing a refrigeration cycle in which the first compressor is stopped and the second compressor is driven and a second operation of performing a refrigeration cycle in which the first and second compressors and are driven, the refrigerant circuit including a bypass line (PB) that connects a suction side and the discharge side of the first compressor together, such that fluid may flow between the suction side and the discharge side of the first compressor through the bypass line (PB), the bypass line including a check valve thereon which allows refrigerant to flow from the suction s of the first compressor to the discharge side of the first compressor through the bypass line and restricts flow of refrigerant of the discharge side of the first compressor to the suction side of the first compressor through the bypass line, the refrigeration apparatus further including a reduction mechanism configured to reduce a refrigerant flowing into the first compressor while a first condition is satisfied during the first operation, the first condition indicating that an internal pressure of the first compressor is lower than an evaporation pressure of the evaporator.

2. The refrigeration apparatus of claim 1, wherein the first condition is a condition where an internal temperature of the first compressor is lower than an evaporation temperature of the evaporator.

3. The refrigeration apparatus of claim 2, further comprising:

a first temperature sensor, wherein the first temperature sensor detects a temperature of at least one of an outer surface of a casing of the first compressor, an inside of the casing of the first compressor, a suction line of the first compressor, a discharge line of the first compressor, or outdoor air, the internal temperature of the first compressor is a value based on a detection value detected by the first temperature sensor.

4. The refrigeration apparatus of claim 1, wherein the reduction mechanism includes a valve connected between the first compressor and an outlet end of the bypass line (PB), and the valve is closed while the first condition is satisfied.

5. The refrigeration apparatus of claim 2, wherein the reduction mechanism includes a valve connected between the first compressor and an outlet end of the bypass line (PB), and the valve is closed while the first condition is satisfied.

6. The refrigeration apparatus of claim 3, wherein the reduction mechanism includes a valve connected between the first compressor and an outlet end of the bypass line (PB), and the valve is closed while the first condition is satisfied.

7. The refrigeration apparatus of claim 1, wherein the reduction mechanism includes a heating section configured to heat the first compressor while the first condition is satisfied.

8. The refrigeration apparatus of claim 2, wherein the reduction mechanism includes a heating section configured to heat the first compressor while the first condition is satisfied.

9. The refrigeration apparatus of claim 3, wherein the reduction mechanism includes a heating section configured to heat the first compressor while the first condition is satisfied.

10. The refrigeration apparatus of claim 7, wherein the heating section includes a heater provided in the first compressor and energized while the first condition is satisfied.

11. The refrigeration apparatus of claim 8, wherein the heating section includes a heater provided in the first compressor and energized while the first condition is satisfied.

12. The refrigeration apparatus of claim 9, wherein the heating section includes a heater provided in the first compressor and energized while the first condition is satisfied.

13. The refrigeration apparatus of claim 7, wherein the heating section includes a motor provided in the first compressor and energized under an open-phase condition while the first condition is satisfied.

14. The refrigeration apparatus of claim 8, wherein the heating section includes a motor provided in the first compressor and energized under an open-phase condition while the first condition is satisfied.

15. The refrigeration apparatus of claim 9, wherein the heating section includes a motor provided in the first compressor and energized under an open-phase condition while the first condition is satisfied.

16. The refrigeration apparatus of claim 1, wherein the reduction mechanism includes a decompression mechanism configured to lower the evaporation pressure of the evaporator while the first condition is satisfied.

17. The refrigeration apparatus of claim 2, wherein the reduction mechanism includes a decompression mechanism configured to lower the evaporation pressure of the evaporator while the first condition is satisfied.

18. The refrigeration apparatus of claim 3, wherein the reduction mechanism includes a decompression mechanism configured to lower the evaporation pressure of the evaporator while the first condition is satisfied.

19. A refrigeration apparatus, comprising:

a refrigerant circuit including a first compressor, a second compressor connected to a discharge side of the first compressor, and an evaporator, the refrigerant circuit being switchable between a first operation of performing a refrigeration cycle in which the first compressor is stopped and the second compressor is driven and a second operation of performing a refrigeration cycle in which the first and second compressors and are driven, the refrigerant circuit including a bypass line (PB) that connects a suction side and the discharge side of the first compressor together, the refrigeration apparatus further including a reduction mechanism configured to reduce a refrigerant flowing into the first compressor while a first condition is satisfied during the first operation, the first condition indicating that an internal pressure of the first compressor is lower than an evaporation pressure of the evaporator and configured to lower the evaporation pressure of the evaporator while the first condition is satisfied.

* * * * *